US009570000B2

(12) United States Patent
Yin et al.

(10) Patent No.: US 9,570,000 B2
(45) Date of Patent: Feb. 14, 2017

(54) PIXEL CIRCUIT AND DRIVING METHOD THEREOF, ORGANIC LIGHT-EMITTING DISPLAY PANEL AND DISPLAY APPARATUS

(71) Applicant: BOE TECHNOLOGY GROUP CO., LTD., Beijing (CN)

(72) Inventors: Jingwen Yin, Beijing (CN); Zhongyuan Wu, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 89 days.

(21) Appl. No.: 14/345,625

(22) PCT Filed: May 20, 2013

(86) PCT No.: PCT/CN2013/075912
§ 371 (c)(1),
(2) Date: Mar. 18, 2014

(87) PCT Pub. No.: WO2014/153820
PCT Pub. Date: Oct. 2, 2014

(65) Prior Publication Data

US 2014/0312784 A1 Oct. 23, 2014

(30) Foreign Application Priority Data

Mar. 29, 2013 (CN) ..... 2013 1 0109386

(51) Int. Cl.
*G09G 3/32* (2006.01)

(52) U.S. Cl.
CPC ..... *G09G 3/3208* (2013.01); *G09G 3/3233* (2013.01); *G09G 2300/0819* (2013.01);
(Continued)

(58) Field of Classification Search
CPC ..... G09G 3/3208; G09G 3/3233
See application file for complete search history.

(56) References Cited

U.S. PATENT DOCUMENTS

2007/0085847 A1 4/2007 Shishido
2007/0120795 A1 5/2007 Uchino et al.
(Continued)

FOREIGN PATENT DOCUMENTS

CN 1799081 A 7/2006
CN 101183508 A 5/2008
(Continued)

OTHER PUBLICATIONS

International Search Report of PCT/CN2013/075912 mailed on Jan. 2, 2014.
(Continued)

*Primary Examiner* — Afroza Chowdhury
(74) *Attorney, Agent, or Firm* — Collard & Roe, P.C.

(57) ABSTRACT

The present disclosure relates to the field of organic light-emitting display, and provides a pixel circuit, a driving method thereof, an organic light-emitting display panel and a display apparatus, comprising a driving transistor, a first storage capacitor, a collecting unit, a writing unit and a light-emitting unit; wherein, the collecting unit is used for collecting the threshold voltage of the driving transistor and storing the threshold voltage into the first storage capacitor, under the control of the first scan signal; the writing unit is used for storing the data voltage inputted from the input terminal for the data voltage under the control of the second scan signal; and the light-emitting unit is used for emitting lights, driven by the data voltage and a voltage inputted from the input terminal for the controllable low voltage, under the control of the light-emitting control signal. Thus an organic light-emitting device is not affected by the threshold voltage shift of the driving transistor, which may enhance the image uniformity of the organic light-emitting display panel effectively, slow down the decay speed of an organic light-
(Continued)

emitting device and ensure the uniformity and a constancy of brightness of the organic light-emitting display panel.

13 Claims, 5 Drawing Sheets

(52) U.S. Cl.
CPC ..... *G09G 2300/0852* (2013.01); *G09G 2300/0861* (2013.01); *G09G 2320/0233* (2013.01)

(56) References Cited

U.S. PATENT DOCUMENTS

| | | | | |
|---|---|---|---|---|
| 2008/0111766 | A1 | 5/2008 | Uchino et al. | |
| 2009/0179838 | A1 | 7/2009 | Yamashita et al. | |
| 2009/0179888 | A1 | 7/2009 | Yamashita et al. | |
| 2010/0020059 | A1* | 1/2010 | Suh ..... | G09G 3/3233 345/212 |
| 2010/0259531 | A1* | 10/2010 | Ono ..... | G09G 3/3233 345/212 |
| 2013/0063040 | A1 | 3/2013 | Huang et al. | |
| 2013/0169170 | A1 | 7/2013 | Shih | |

FOREIGN PATENT DOCUMENTS

| | | | |
|---|---|---|---|
| CN | 101964175 | A | 2/2011 |
| CN | 102665321 | A | 9/2012 |
| CN | 103000127 | A | 3/2013 |
| CN | 203134329 | U | 8/2013 |
| JP | 2007108733 | A | 4/2007 |

OTHER PUBLICATIONS

International Preliminary Report on Patentability and Written Opinion of the International Searching Authority of PCT/CN2013/075912 mailed on Jan. 2, 2014.

Second Office Action of Chinese Application No. 2013101093865 in Chinese with English translation, mailed Apr. 7, 2015.

Chinese Office Action of Chinese Application No. 201310109386.5 with English translation, mailed Sep. 29, 2014.

English Translation of the International Search Report of PCT/CN2013/075912 published in English on Oct. 2, 2014.

English translation of the International Preliminary Report on Patentability and Written Opinion of the International Searching Authority of PCT/CN2013/075912, issued Sep. 29, 2015.

* cited by examiner

PIXEL CIRCUIT AND DRIVING METHOD THEREOF, ORGANIC LIGHT-EMITTING DISPLAY PANEL AND DISPLAY APPARATUS

CROSS REFERENCE TO RELATED APPLICATIONS

This application is the National Stage of PCT/CN2013/075912 filed on May 20, 2013, which claims priority under 35 U.S.C. §119 of Chinese Application No. 201310109386.5 filed on Mar. 29, 2013, the disclosure of which is incorporated by reference. The international application under PCT article 21(2) was not published in English.

TECHNICAL FIELD

The present invention relates to the field of organic light-emitting display, and particularly, to a pixel circuit and a driving method thereof, an organic light-emitting display panel and a display apparatus.

BACKGROUND

With a rapid development of the multimedia society, the technique for semiconductor elements and a display apparatus has got a great and rapid progress.

In terms of the displays, an Active Matrix Organic Light-Emitting Diode (AMOLED) display meets those characteristic requirements for a display in the multimedia era, because it has advantages such as no limitations on an angle of view, a low manufacture cost, a high response speed (about hundred times and more of that of the liquid crystal), energy saving, self-luminous, being applicable to a direct-current driving for a portable device, a wider operation temperature scope, and a lighter weight while being miniaturized and thinned along with the hardware devices, and the like. Therefore, the Active Matrix Organic Light-Emitting Diode display has a great potential of development and may be desired to become a next generation of the new flat panel display and to replace the Liquid Crystal Display (LCD).

Currently, there are two ways of manufacturing the Active Matrix Organic Light-Emitting Diode display panel, one way of which is to utilize a process technique for Thin Film Transistors (TFTs) of the Low Temperature Poly-Silicon (LTPS), and the other way of which is to utilize a process technique for the Thin Film Transistors (TFTs) of the amorphous silicon (α-Si). Herein, the process technique for the Thin Film Transistors of the Low Temperature Poly-Silicon would need more processes for mask manufacturing craft and thus lead to an increasing of the cost. Therefore, the process technique for Thin Film Transistors of the Low Temperature Poly-Silicon is mostly applied to the panel having a small or medium size, while the process technique for the Thin Film Transistors of the amorphous silicon is mostly applied to the panel having a large size.

Generally, for an Active Matrix Organic Light-Emitting Diode display panel manufactured by the process technique for Thin Film Transistors of the Low Temperature Poly-Silicon, the thin film transistors in the pixel circuit may be P-type or N-type, but no matter whether the P-type or N-type transistors are selected to implement the organic light-emitting diode pixel circuit, the current flowing through an organic light-emitting diode may not only change with the changes caused by a long time stress in a turn-on voltage (Voled_th) of the organic light-emitting diode, but also vary with a threshold voltage shift (Vth shift) in the thin film transistor for driving the organic light-emitting diode. As a result, the brightness uniformity and the brightness constancy of the organic light-emitting display may be affected correspondingly.

SUMMARY

The present disclosure provides a pixel circuit and a driving method thereof, an organic light-emitting display panel and a display apparatus, which are capable of enhancing the image uniformity of the organic light-emitting display panel effectively, slowing down a decay speed of an organic light-emitting device and ensuring the uniformity and the constancy of brightness of the organic light-emitting display panel.

In an exemplary embodiment of the present disclosure, there is provided a pixel circuit comprising a driving transistor, a first storage capacitor, a collecting unit, a writing unit and a light-emitting unit; wherein, a source of the driving transistor is connected with an input terminal for a power supply voltage;

a first terminal of the first storage capacitor is connected with a gate of the driving transistor;

the collecting unit is connected with an input terminal for a first scan signal, an input terminal for a controllable low voltage, the driving transistor, the first terminal of the first storage capacitor, the writing unit and the light-emitting unit, respectively, and is used for collecting a threshold voltage of the driving transistor and storing the threshold voltage into the first storage capacitor, under the control of the first scan signal;

the writing unit is connected with an input terminal for a second scan signal, an input terminal for a data voltage, the input terminal for the controllable low voltage, a second terminal of the first storage capacitor and the collecting unit, respectively, and is used for storing the data voltage inputted from the input terminal for the data voltage under the control of the second scan signal; and the light-emitting unit is connected with an input terminal for an light-emitting control signal, a drain of the driving transistor and the collecting unit, respectively, and is used for emitting lights driven by the data voltage and a voltage inputted from the input terminal for the controllable low voltage, under the control of the light-emitting control signal.

Optionally, the collecting unit comprises:

a second transistor, a fourth transistor and a fifth transistor;

a source of the second transistor is connected with the drain of the driving transistor, a gate of the second transistor is connected with the input terminal for the first scan signal, and a drain of the second transistor is connected with the gate of the driving transistor;

a source of the fourth transistor is connected with the second terminal of the first storage capacitor, a gate of the fourth transistor is connected with the input terminal for the first scan signal, and a drain of the fourth transistor is connected with the input terminal for the controllable low voltage;

a gate of the fifth transistor is connected with the input terminal for the first scan signal, and a drain of the fifth transistor is connected with the input terminal for the controllable low voltage.

Optionally, the writing unit comprises:

a third transistor and a second storage capacitor;

a source of the third transistor is connected with the second terminal of the first storage capacitor, a first terminal of the second storage capacitor, the source of the fourth transistor, respectively, a gate of the third transistor is connected with the input terminal for the second scan signal, and a drain of the third transistor is connected with the input terminal for the data voltage; and a second terminal of the second storage capacitor is connected with the input terminal for the controllable low voltage.

Optionally, the light-emitting unit comprises:

a sixth transistor and an organic light-emitting diode;

a source of the sixth transistor is connected with the drain of the driving transistor, the source of the second transistor, respectively, a gate of the sixth transistor is connected with the input terminal for the light-emitting control signal, and a drain of the sixth transistor is connected with the source of the fifth transistor and a anode of the organic light-emitting diode, respectively; and a cathode of the organic light-emitting diode is grounded.

Optionally, all of the driving transistor, the second transistor, the third transistor, the fourth transistor, the fifth transistor and the sixth transistor are P-type transistors.

Optionally, the input terminal for the controllable low voltage is grounded.

In an exemplary embodiment of the present disclosure, there is further provided a pixel driving method for driving the pixel circuit according to the above embodiment of the present disclosure, comprising:

during a data collecting stage, the second transistor, the third transistor and the fourth transistor are in a turn-on state under the control of the first scan signal, the third transistor is in a turn-off state under the control of the second scan signal, the gate and the drain of the driving transistor are connected, a threshold voltage of the driving transistor is stored into the first storage capacitor, and the sixth transistor is in the turn-off state under the control of the light-emitting control signal;

during a data inputting stage, the second transistor, the third transistor and the fourth transistor are in the turn-off state under the control of the first scan signal, the third transistor is in the turn-on state under the control of the second scan signal, the data voltage inputted from the input terminal for the data voltage is stored into the second storage capacitor, and the sixth transistor is in the turn-off state under the control of the light-emitting control signal;

during a light-emitting stage, the second transistor, the third transistor and the fourth transistor are in the turn-off state under the control of the first scan signal, the third transistor is in the turn-off state under the control of the second scan signal, the sixth transistor is in the turn-on state under the control of the light-emitting control signal, and the organic light-emitting diode emits lights driven by the data voltage and the voltage inputted from the input terminal for the controllable low voltage.

Optionally, during the data collecting stage, the first scan signal is at a low level, the second scan signal is at a high level and the light-emitting control signal is at the high level;

during the data inputting stage, the first scan signal is at the high level, the second scan signal is at the low level and the light-emitting control signal is at the high level; and during the light-emitting stage, the first scan signal is at the high level, the second scan signal is at the high level and the light-emitting control signal is at the low level.

The embodiment of the present disclosure further provide an organic light-emitting display panel which may comprise the pixel circuit according to the embodiments of the present disclosure.

The embodiments of the present disclosure further provide a display apparatus which may specifically comprise the organic light-emitting display panel according to the embodiment of the present disclosure.

It can be seen from the above that, the pixel circuit and the driving method thereof, the organic light-emitting display panel and the display apparatus according to the embodiments of the present disclosure comprise the driving transistor, the first storage capacitor, the collecting unit, the writing unit and the light-emitting unit; wherein, the collecting unit is used for collecting the threshold voltage of the driving transistor and storing the threshold voltage into the first storage capacitor, under the control of the first scan signal; the writing unit is used for storing the data voltage inputted from the input terminal for the data voltage under the control of the second scan signal; and the light-emitting unit is used for emitting lights, driven by the data voltage and a voltage inputted from the input terminal for the controllable low voltage, under the control of the light-emitting control signal. Thus, an organic light-emitting device is not affected by the threshold voltage drift of the driving transistor, which may enhance the image uniformity of the organic light-emitting display panel effectively, which may slow down the decay speed of an organic light-emitting device and which ensure the uniformity and a constancy of brightness of the organic light-emitting display panel.

DETAILED DESCRIPTION

Thereafter, solutions of embodiments of the present disclosure will be described clearly and completely in connection with drawings of the embodiments of the present disclosure, in order to explain problems to be settled, solutions and advantages in embodiments of the present disclosure more clearly. It is apparent that the described embodiments are only some, but not all of the embodiments of the present disclosure. Any other embodiments obtained by those ordinary skilled in the art based on the embodiments of the present disclosure without inventive labors should fall into a scope sought for protection in the present disclosure.

Unless otherwise defined, the technical terms or the scientific terms used herein have the same meaning as commonly understood by one of ordinary skilled in the art to which this invention belongs. It will be understood that the terms "first", "second" and similar terms used in the specification and claims of the present application cannot be considered as presenting any orders, numbers or importance, but are only used to distinguish different component parts. Also, words "a" or "an" and the like does not present any limitation on numbers, but is used to present a presentation of at least one related item. Words "connected to" or "connected with" and the like are not limited to physical or mechanical connections, but may comprise electrical connections, either direct connections or indirect connections. Relative terms, such as "above", "under", "left" and "right", may be used herein to describe a relative position relationship, and the relative position relationship may be changed correspondingly when an absolute position of an object changes.

Figure 1:
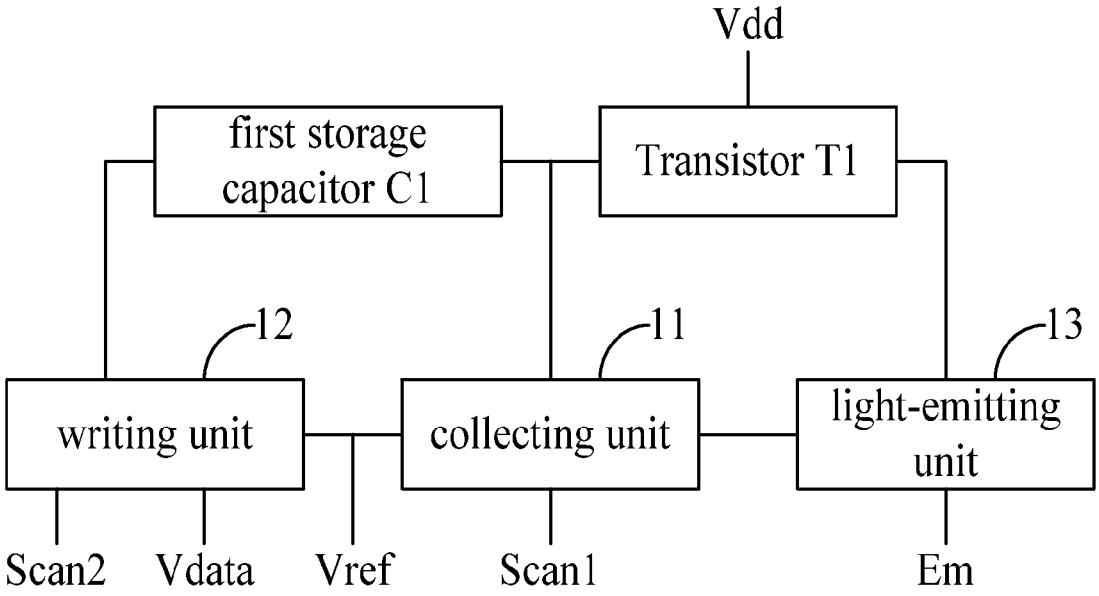
FIG. 1 is a first schematic diagram illustrating a structure of a pixel circuit according to embodiments of the present disclosure.

In an exemplary embodiment of the present disclosure, there is provided a pixel circuit, as illustrated in FIG. 1, and the pixel circuit may comprise:

a driving transistor T1, a first storage capacitor C1, a collecting unit 11, a writing unit 12 and a light-emitting unit 13; wherein, the source of the driving transistor T1 is connected with an input terminal for a power supply voltage Vdd;

a first terminal of the first storage capacitor C1 is connected with the gate of the driving transistor T1;

the collecting unit 11 is connected with an input terminal for a first scan signal Scan1, an input terminal for a controllable low voltage Vref, the driving transistor T1, the first terminal of the first storage capacitor C1, the writing unit 12 and the light-emitting unit 13, respectively, and is used for collecting a threshold voltage Vth of the driving transistor T1 and storing the threshold voltage Vth into the first storage capacitor C1, under the control of the first scan signal Scan1;

the writing unit 12 is connected with an input terminal for a second scan signal Scan2, an input terminal for a data voltage Vdata, the input terminal for the controllable low voltage Vref, a second terminal of the first storage capacitor C1 and the collecting unit 11, respectively, and is used for storing the data voltage Vdata inputted from the input terminal for the data voltage Vdata under the control of the second scan signal Scan2; and the light-emitting unit 13 is connected with an input terminal for an light-emitting control signal Em, a drain of the driving transistor T1 and the collecting unit 11, respectively, and is used for emitting lights driven by the data voltage Vdata and a voltage inputted from the input terminal for the controllable low voltage Vref, under the control of the light-emitting control signal Em.

The pixel unit according to the embodiments of the present disclosure is capable of enhancing an image uniformity of the organic light-emitting display panel effectively, slowing down a decay speed of an organic light-emitting device and ensuring the uniformity and the constancy of brightness of the organic light-emitting display panel.

Figure 2:
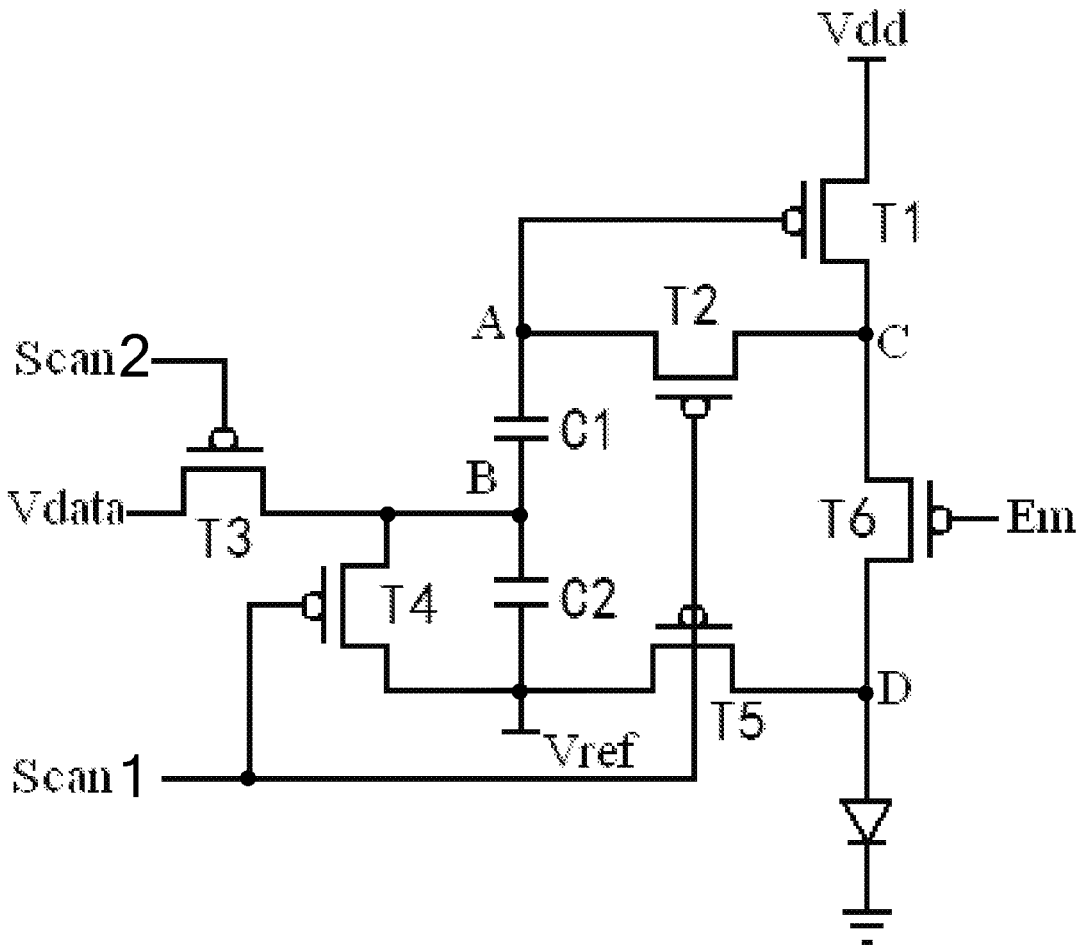
FIG. 2 is a second schematic diagram illustrating the structure of the pixel circuit according to the embodiments of the present disclosure.

In an alternative specific embodiment, as illustrated in FIG. 2, the collecting unit 11 may comprise:

a second transistor T2, a fourth transistor T4 and a fifth transistor T5;

wherein, the source of the second transistor T2 is connected with the drain of the driving transistor T1, the gate of the second transistor T2 is connected with the input terminal for the first scan signal Scan1, and the drain of the second transistor T2 is connected with the gate of the driving transistor T1 (that is, the driving transistor T1, the first storage capacitor C1 and the second thin film transistor T2 are connected at a node A);

the source of the fourth transistor T4 is connected with the second terminal of the first storage capacitor C1, the gate of the fourth transistor T4 is connected with the input terminal for the first scan signal Scan1, and the drain of the fourth transistor T4 is connected with the input terminal for the controllable low voltage Vref;

the gate of the fifth transistor T5 is connected with the input terminal for the first scan signal Scan1, and the drain of the fifth transistor T5 is connected with the input terminal for the controllable low voltage Vref.

In an alternative embodiment, as illustrated in FIG. 2, the writing unit 12 may comprise:

a third transistor T3 and a second storage capacitor C2; wherein, the source of the third transistor T3 is connected with the second terminal of the first storage capacitor C1, a first terminal of the second storage capacitor C2 (that is, the third transistor T3, the first storage capacitor C1 and the second storage capacitor C2 are connected at a node B) and the source of the fourth transistor T4, respectively, the gate of the third transistor T3 is connected with the input terminal for the second scan signal Scan2, and the drain of the third transistor T3 is connected with the input terminal for the data voltage Vdata; and a second terminal of the second storage capacitor C2 is connected with the input terminal for the controllable low voltage Vref.

In an alternative embodiment, as illustrated in FIG. 2, the light-emitting unit 13 may comprise:

a sixth transistor T6 and an organic light-emitting diode (OLED);

the source of the sixth transistor T6 may be connected with the drain of the driving transistor T1 and the source of the second transistor T2 (that is, the driving transistor T1, the second transistor T2 and the sixth transistor T6 are connected at a node C), respectively, the gate of the sixth transistor T6 may be connected with the input terminal for the light-emitting control signal Em, and the drain of the sixth transistor T6 may be connected respectively with the source of the fifth transistor T5 and the anode of the organic light-emitting diode (that is, the fifth transistor T5, the sixth transistor T6 and the organic light-emitting diode are connected at a node D); and the cathode of the organic light-emitting diode is grounded.

The transistors utilized in the above embodiments of the present disclosure, such as the driving transistor T1, the second transistor T2, the third transistor T3, the fourth transistor T4, the fifth transistor T5 and the sixth transistor T6, may be P-type transistors, and the sources and the drains of the above transistors may be exchanged.

Figure 3:
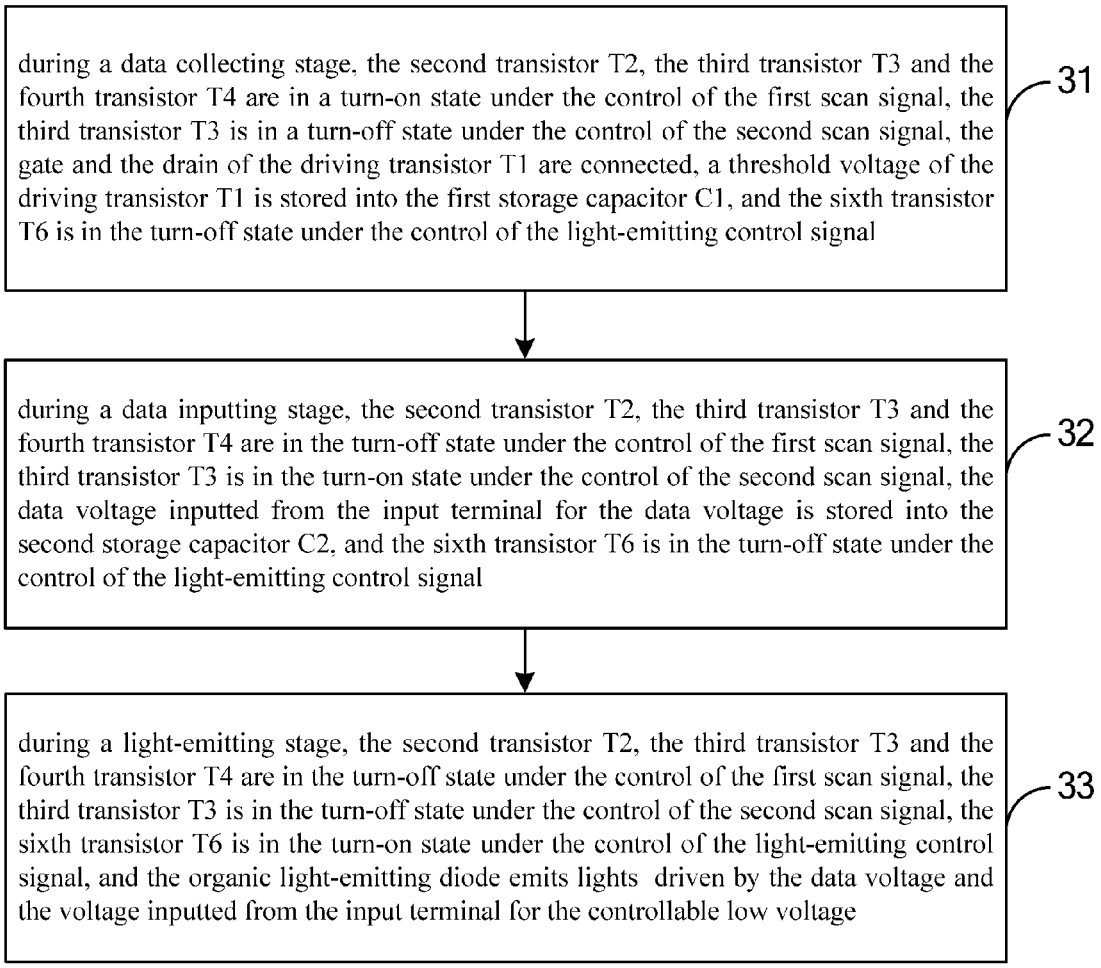
FIG. 3 is a schematic diagram illustrating the flow of the driving method for the pixel circuit according to the embodiments of the present disclosure.

The embodiments of the present disclosure further provide a pixel driving method, as illustrated in FIG. 3, and the method may comprise:

step 31, during a data collecting stage, the second transistor T2, the third transistor T3 and the fourth transistor T4 are in a turn-on state under the control of the first scan signal Scan1, the third transistor T3 is in a turn-off state under the control of the second scan signal Scan2, the gate and the drain of the driving transistor T1 are connected, a threshold voltage Vth of the driving transistor T1 is stored into the first storage capacitor C1, and the sixth transistor T6 is in the turn-off state under the control of the light-emitting control signal Em;

step 32, during a data inputting stage, the second transistor T2, the third transistor T3 and the fourth transistor T4 are in the turn-off state under the control of the first scan signal Scan1, the third transistor T3 is in the turn-on state under the control of the second scan signal Scan2, the data voltage Vdata inputted from the input terminal for the data voltage Vdata is stored into the second storage capacitor C2, and the sixth transistor T6 is in the turn-off state under the control of the light-emitting control signal Em;

step 33, during a light-emitting stage, the second transistor T2, the third transistor T3 and the fourth transistor T4 are in the turn-off state under the control of the first scan signal Scan1, the third transistor T3 is in the turn-off state under the control of the second scan signal Scan2, the sixth transistor T6 is in the turn-on state under the control of the light-emitting control signal Em, and the organic light-emitting diode emits lights driven by the data voltage Vdata and the voltage inputted from the input terminal for the controllable low voltage Vref.

Thereafter a specific implementation procedure of the pixel driving method according to the embodiments of the present disclosure will be described in details by taking the pixel circuit shown in FIG. 2 as an example.

Figure 4:
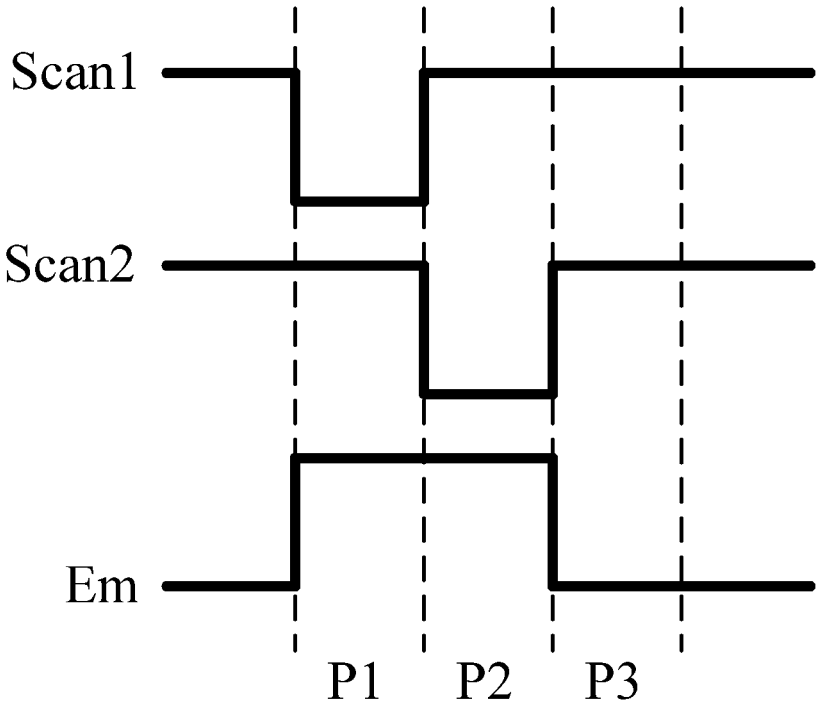
FIG. 4 is a timing diagram of driving signals for the pixel circuit according to the embodiments of the present disclosure.

In this embodiment, an applicable signal timing diagram may be as illustrated in FIG. 4.

That is, during the data collecting stage P1, the input terminal for the first scan signal Scan1 inputs a low level, the input terminal for the second scan signal Scan2 inputs a high level and the input terminal for the light-emitting control signal Em inputs the high level;

during the data inputting stage P2, the input terminal for the first scan signal Scan1 inputs a high level, the input terminal for the second scan signal Scan2 inputs a low level and the input terminal for the light-emitting control signal Em inputs a high level; and during the light-emitting stage P3, the input terminal for the first scan signal Scan1 inputs a high level, the input terminal for the second scan signal Scan2 inputs a high level and the input terminal for the light-emitting control signal Em inputs a low level.

Particularly, the execution processes of the above pixel driving method are as follows.

In the first stage P1, because the first scan signal Scan1 is the low level, the second transistor T2, the fourth transistor T4 and the fifth transistor T5 included in the collecting unit 12 are all turned on. Accordingly, the second storage capacitor C2 will be reset and store the controllable low voltage Vref at the node D, and a potential at the anode of the organic light-emitting diode included in the light-emitting unit 13 is the controllable low voltage Vref, which is not in a state of a positive bias voltage, and may slows down the decay speed of the organic light-emitting diode, so that a usage lifespan of the organic light-emitting display panel may be increased. The driving transistor T1 is in a connection state as a diode because of the turning on of a collecting transistor, that is, the second transistor T2, and stores the threshold voltage Vth of the driving transistor T1 into the first storage capacitor C1, and at this time, a potential at the node A is Vdd−|Vth|.

In the second stage P2, because the second scan signal Scan2 is in the low level, the writing transistor, that is, the third transistor T3, is turned on. Accordingly, the data voltage Vdata will be stored in the second storage capacitor C2, a potential at the node B becomes the data voltage Vdata (the data voltage Vdata is a negative value). Because of a booting effect of the first storage capacitor C1, the potential at the node A will have a same raise of the potential, that is, the potential at the node A=Vdd−|Vth|+Vdata−Vref. At this time, the gate-source voltage Vsg of the driving transistor T1 is Vsg=Vdd−(Vdd−|Vth|+Vdata−Vref)=|Vth|−Vdata+Vref.

In the third stage P3, because the light-emitting control signal Em is at the low level, the light-emitting control transistor, that is, the sixth transistor T6 is turned on. At this time, the voltage Vsg of the driving transistor T1 has no changes such that the driving current $I_{OLED}$ generated by the driving transistor T1 in the third stage P3 may be expressed as the following equation:

$$\begin{aligned} I_{OLED} &= \frac{1}{2}K\times(Vsg-|Vth|)^2 \\ &= \frac{1}{2}K\times(|Vth|-Vdata+Vref-|Vth|)^2 \\ &= \frac{1}{2}K\times(-Vdata+Vref)^2, \end{aligned}$$

where K is a current constant associated with the driving transistor T1.

Herein, it can be seen from the equation that in the light-emitting stage P3, the driving current $I_{OLED}$ flowing through the organic light-emitting diode is independent of the threshold voltage (Vth) of the driving transistor T1. Further, it also can be seen from the equation that the driving current $I_{OLED}$ flowing through the organic light-emitting diode is further decided by an additional parameter Vref, and this additional variable parameter may relieve a phenomenon of brightness decay caused by a long time usage of the organic light-emitting diode and may decide that the driving current $I_{OLED}$ flowing through the organic light-emitting diode is not controlled by the Vdd, in other words, not affected by the IR drop. Thus, the uniformity and the constancy of brightness of the organic light-emitting display panel may be ensured.

Then, it can be seen that the pixel circuit provided by the embodiments of the present disclosure implements the storing of the threshold voltage Vth of the driving transistor T1 by controlling the signal lines to make the driving transistor T1 connected as the diode, so that it is prevented from being affected by the raising of the threshold voltage Vth of the driving transistor T1 and the power supply line VDD I-R drop.

The storing of the variable voltage Vref can be implemented by the boosting effect of the capacitor, so that the organic light-emitting diode is not in the positive bias state for a long time, which may slow down a decay speed of the organic light-emitting diode.

Figure 5:
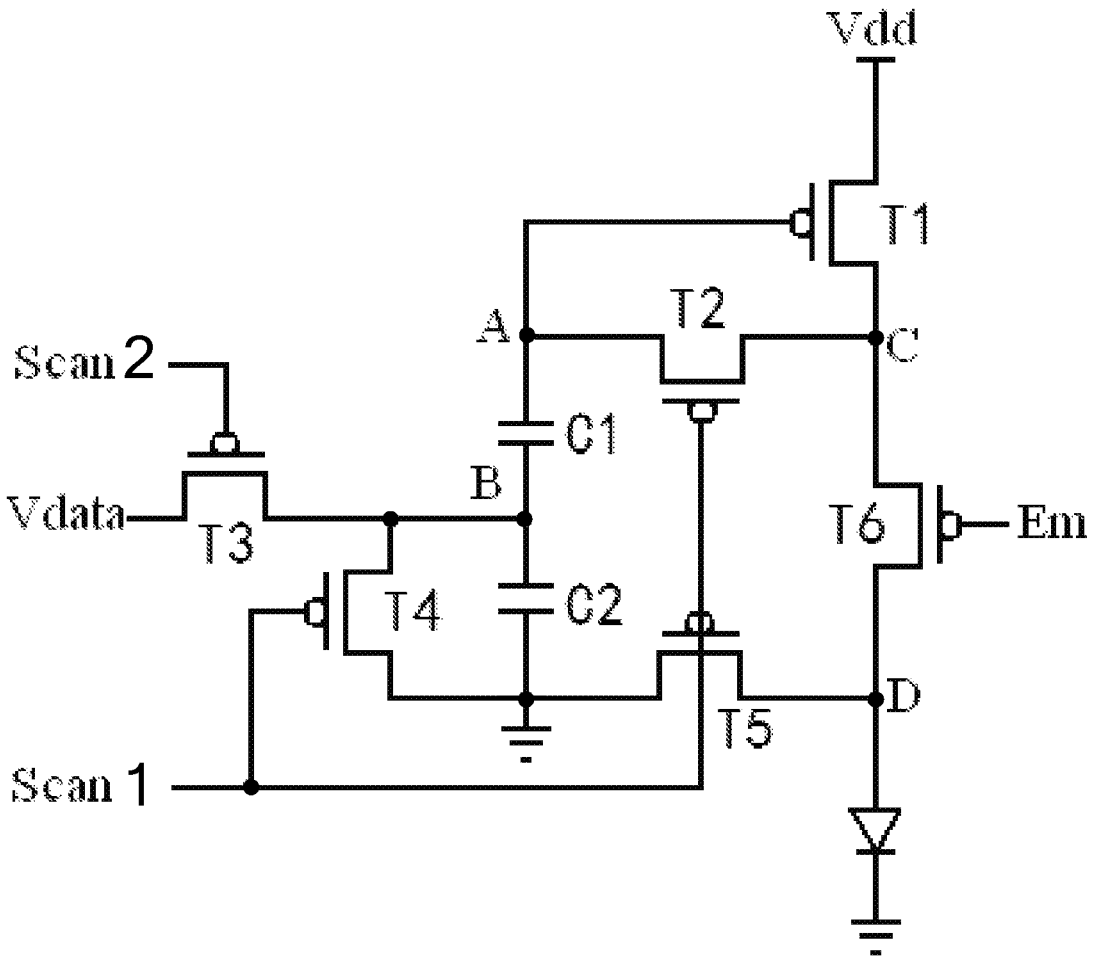
FIG. 5 is a third schematic diagram illustrating the structure of the pixel circuit according to the embodiments of the present disclosure.

In an alternative embodiment of the present invention, the input terminal for the controllable low voltage Vref in the above pixel circuit may also be grounded, and the advantage is that it may reduce the related control voltages and simplify the design difficulties for the related ICs. A detailed circuit diagram is referred to FIG. 5, and the operation principle is similar to the above solution, so details are omitted herein.

Based on the pixel circuit according to the embodiments of the present invention, the embodiments of the present invention further provide an organic light-emitting display panel which may comprise the pixel circuit according to the embodiments of the present invention.

The embodiments of the present invention further provide a display apparatus which may comprise the pixel circuit according to the embodiments of the present invention.

The embodiments of the present invention provide a pixel circuit and a driving method thereof, an organic light-emitting display panel and a display apparatus, comprising the driving transistor T1, the first storage capacitor C1, the collecting unit, the writing unit and the light-emitting unit; wherein, the collecting unit is used for collecting the threshold voltage of the driving transistor T1 and storing the threshold voltage into the first storage capacitor C1, under the control of the first scan signal; the writing unit is used for storing the data voltage inputted from the input terminal for the data voltage under the control of the second scan signal; and the light-emitting unit is used for emitting lights driven by the data voltage and a voltage inputted from the input terminal for the controllable low voltage, under the control of the light-emitting control signal. Thus an organic light-emitting device is not affected by the threshold voltage shift of the driving transistor, which may enhance the image uniformity of the organic light-emitting display panel effectively, slow down the decay speed of an organic light-emitting device and ensure the uniformity and the constancy of brightness of the organic light-emitting display panel.

The above descriptions only illustrate the embodiments of the present invention. It should be noted that variations or improvements, which can be easily made by those skilled in the art without departing from the principle of the disclosure, should also be considered falling into the protection scope of the present invention. Thus, the protection scope of the present invention is defined by the claims.

What is claimed is:

1. A pixel circuit comprising a driving transistor, a first storage capacitor, a collecting unit, a writing unit and a light-emitting unit; wherein, a source of the driving transistor is connected with an input terminal for a power supply voltage;

a first terminal of the first storage capacitor is connected with a gate of the driving transistor;

the collecting unit is connected with an input terminal for a first scan signal, an input terminal for a controllable low voltage, the driving transistor, the first terminal of the first storage capacitor, the writing unit and the light-emitting unit, respectively, and is used for collecting a threshold voltage of the driving transistor and storing the threshold voltage into the first storage capacitor, under the control of the first scan signal;

the writing unit is connected with an input terminal for a second scan signal, an input terminal for a data voltage, the input terminal for the controllable low voltage, a second terminal of the first storage capacitor and the collecting unit, respectively, and is used for storing the data voltage inputted from the input terminal for the data voltage under the control of the second scan signal; and the light-emitting unit is connected with an input terminal for a light-emitting control signal, a drain of the driving transistor and the collecting unit, respectively, and is used for emitting lights driven by the data voltage and a voltage inputted from the input terminal for the controllable low voltage, under the control of the light-emitting control signal, wherein the collecting unit comprises:

a second transistor, a fourth transistor and a fifth transistor;

a source of the second transistor is connected with the drain of the driving transistor, a gate of the second transistor is connected with the input terminal for the first scan signal, and a drain of the second transistor is connected with the gate of the driving transistor;

a source of the fourth transistor is connected with the second terminal of the first storage capacitor, a gate of the fourth transistor is connected with the input terminal for the first scan signal, and a drain of the fourth transistor is connected with the input terminal for the controllable low voltage; and a gate of the fifth transistor is connected with the input terminal for the first scan signal, and a drain of the fifth transistor is connected with the input terminal for the controllable low voltage; and wherein the writing unit comprises:

a third transistor and a second storage capacitor;

a source of the third transistor is connected with the second terminal of the first storage capacitor, a first terminal of the second storage capacitor, the source of the fourth transistor, respectively, a gate of the third transistor is connected with the input terminal for the second scan signal, and a drain of the third transistor is connected with the input terminal for the data voltage; and a second terminal of the second storage capacitor is connected with the input terminal for the controllable low voltage.

2. The pixel circuit of claim 1, wherein the light-emitting unit comprises:

a sixth transistor and an organic light-emitting diode;

a source of the sixth transistor is connected with the drain of the driving transistor, and the source of the second transistor, respectively, a gate of the sixth transistor is connected with the input terminal for the light-emitting control signal, and a drain of the sixth transistor is connected with the source of the fifth transistor and a anode of the organic light-emitting diode, respectively; and a cathode of the organic light-emitting diode is grounded.

3. The pixel circuit of claim 2, wherein all of the driving transistor, the second transistor, the third transistor, the fourth transistor, the fifth transistor and the sixth transistor are P-type transistors.

4. The pixel circuit of claim 1, wherein the input terminal for the controllable low voltage is grounded.

5. A pixel driving method for driving a pixel circuit comprising a driving transistor, a first storage capacitor, a collecting unit, a writing unit and a light-emitting unit, the light-emitting unit comprising a sixth transistor and an organic light-emitting diode;

the method comprising:

during a data collecting stage, the second transistor, the third transistor and the fourth transistor are in a turn-on state under the control of a first scan signal, the third transistor is in a turn-off state under the control of a second scan signal, the gate and the drain of the driving transistor are connected, a threshold voltage of the driving transistor is stored into the first storage capacitor, and the sixth transistor is in the turn-off state under the control of a light-emitting control signal;

during a data inputting stage, the second transistor, the third transistor and the fourth transistor are in the turn-off state under the control of the first scan signal, the third transistor is in the turn-on state under the control of the second scan signal, the data voltage inputted from the input terminal for the data voltage is stored into the second storage capacitor, and the sixth transistor is in the turn-off state under the control of the light-emitting control signal; and during a light-emitting stage, the second transistor, the third transistor and the fourth transistor are in the turn-off state under the control of the first scan signal, the third transistor is in the turn-off state under the control of the second scan signal, the sixth transistor is in the turn-on state under the control of the light-emitting control signal, and the organic light-emitting diode emits lights driven by the data voltage and the voltage inputted from the input terminal for the controllable low voltage;

wherein the collecting unit comprises a second transistor, a fourth transistor and a fifth transistor, a source of the second transistor is connected with the drain of the driving transistor, a gate of the second transistor is connected with the input terminal for the first scan signal, and a drain of the second transistor is connected with the gate of the driving transistor;

a source of the fourth transistor is connected with the second terminal of the first storage capacitor, a gate of the fourth transistor is connected with the input terminal for the first scan signal, and a drain of the fourth transistor is connected with the input terminal for the controllable low voltage; and a gate of the fifth transistor is connected with the input terminal for the first scan signal, and a drain of the fifth transistor is connected with the input terminal for the controllable low voltage; and wherein the writing unit comprises a third transistor and a second storage capacitor, a source of the third transistor is connected with the second terminal of the first storage capacitor, a first terminal of the second storage capacitor, the source of the fourth transistor, respectively, a gate of the third transistor is connected with the input terminal for the second scan signal, and a drain of the third transistor is connected with the input terminal for the data voltage; and a second terminal of the second storage capacitor is connected with the input terminal for the controllable low voltage.

6. The pixel driving method of claim 5, wherein during the data collecting stage, the first scan signal is at a low level, the second scan signal is at a high level and the light-emitting control signal is at the high level;

during the data inputting stage, the first scan signal is at the high level, the second scan signal is at the low level and the light-emitting control signal is at the high level; and during the light-emitting stage, the first scan signal is at the high level, the second scan signal is at the high level and the light-emitting control signal is at the low level.

7. The pixel driving method of claim 5, wherein a source of the sixth transistor is connected with the drain of the driving transistor, and the source of the second transistor, respectively, a gate of the sixth transistor is connected with the input terminal for the light-emitting control signal, and a drain of the sixth transistor is connected with the source of the fifth transistor and a anode of the organic light-emitting diode, respectively; and a cathode of the organic light-emitting diode is grounded.

8. The pixel driving method of claim 5, wherein all of the driving transistor, the second transistor, the third transistor, the fourth transistor, the fifth transistor and the sixth transistor are P-type transistors.

9. The pixel driving method of claim 5, wherein the input terminal for the controllable low voltage is grounded.

10. An organic light-emitting display panel comprising the pixel circuit of claim 1.

11. The organic light-emitting display panel of claim 10, wherein the light-emitting unit comprises:

a sixth transistor and an organic light-emitting diode;

a source of the sixth transistor is connected with the drain of the driving transistor, and the source of the second transistor, respectively, a gate of the sixth transistor is connected with the input terminal for the light-emitting control signal, and a drain of the sixth transistor is connected with the source of the fifth transistor and a anode of the organic light-emitting diode, respectively; and a cathode of the organic light-emitting diode is grounded.

12. The organic light-emitting display panel of claim 11, wherein all of the driving transistor, the second transistor, the third transistor, the fourth transistor, the fifth transistor and the sixth transistor are P-type transistors.

13. The organic light-emitting display panel of claim 10, wherein the input terminal for the controllable low voltage is grounded.

* * * * *